United States Patent [19]

Wiedemar et al.

[11] Patent Number: 4,724,774

[45] Date of Patent: Feb. 16, 1988

[54] SAFE-DEPOSIT INSTALLATION

[75] Inventors: Hans Wiedemar; Daniel Wiedemar, both of Bern, Switzerland

[73] Assignee: Vidmar AG, Bern, Switzerland

[21] Appl. No.: 936,458

[22] Filed: Dec. 1, 1986

[51] Int. Cl.[4] ..... E05G 1/00

[52] U.S. Cl. ..... 109/48; 312/305

[58] Field of Search ..... 109/45, 47, 48; 312/97.1, 267, 305; 232/43.1

[56] References Cited

U.S. PATENT DOCUMENTS

| | | | |
|---|---|---|---|
| 1,062,056 | 5/1913 | Thomas | 109/48 |
| 3,587,485 | 6/1971 | Shea | 109/48 |
| 4,108,518 | 8/1978 | Angst | 312/305 |

FOREIGN PATENT DOCUMENTS

| | | | |
|---|---|---|---|
| 140839 | 5/1985 | European Pat. Off. | 109/48 |

*Primary Examiner*—Neill Wilson

*Attorney, Agent, or Firm*—Flehr, Hohbach, Test, Albritton & Herbert

[57] ABSTRACT

Within a vault (11) having an access aperture (12), a number of rectangular racks (1, 2) are individually and detachably mounted on an annular turntable (14) rotating in a horizontal plane. Each rack accommodates in compartments (6) of variable sizes a single row of individually accessible, superposed safe-deposit boxes (4), all the compartments of any one rack opening out on the same side of that rack. Within the turntable is a vertical hoist mechanism (7) comprising an upright (8) and a horizontal lifting arm (9) travelling along the upright. A selected rack (1*a*) is moved into a starting position by the turntable, seized by the lifting arm, and raised to the level of the access aperture independently of the other racks. There is no possibility of breaking through laterally from a safe-deposit box of any one rack into a safe-deposit box of another rack.

10 Claims, 16 Drawing Figures

Figure 1:
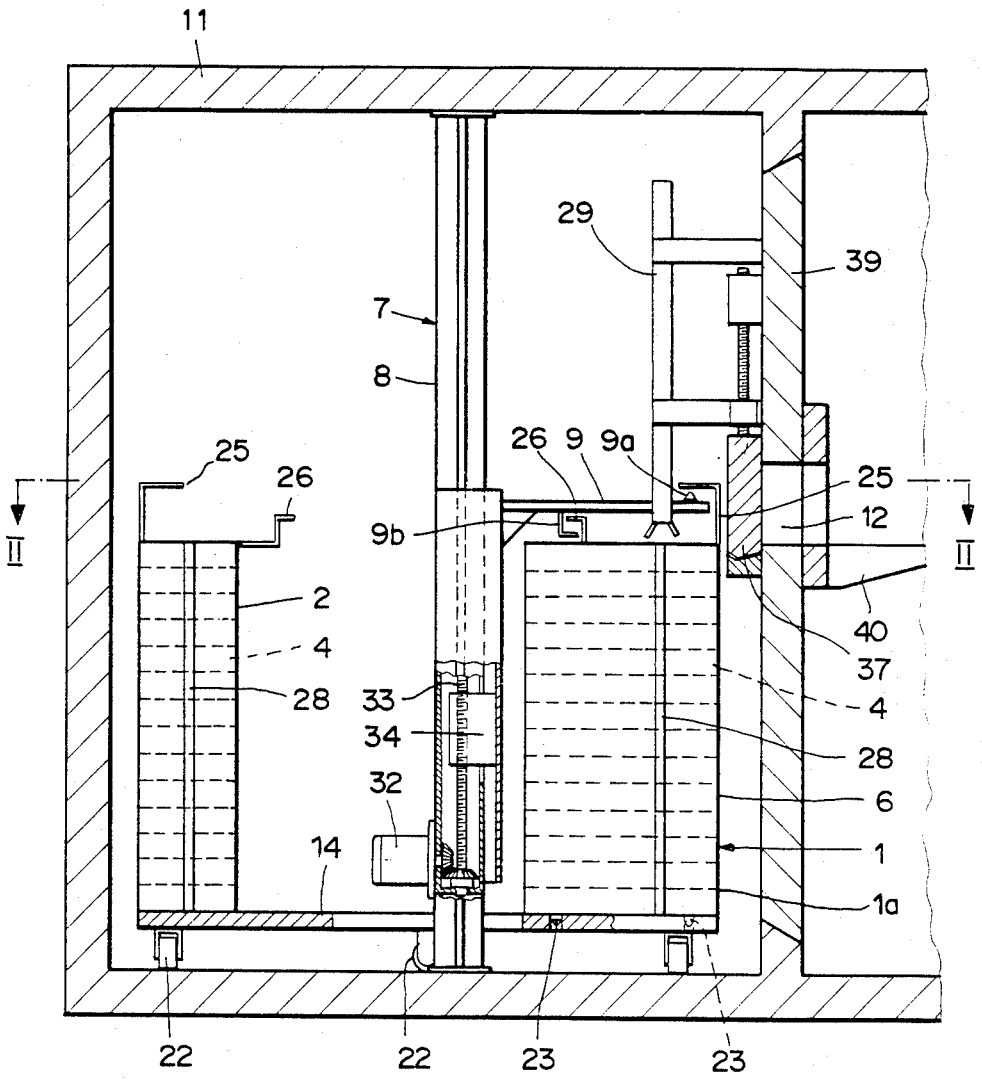

FIG. 7
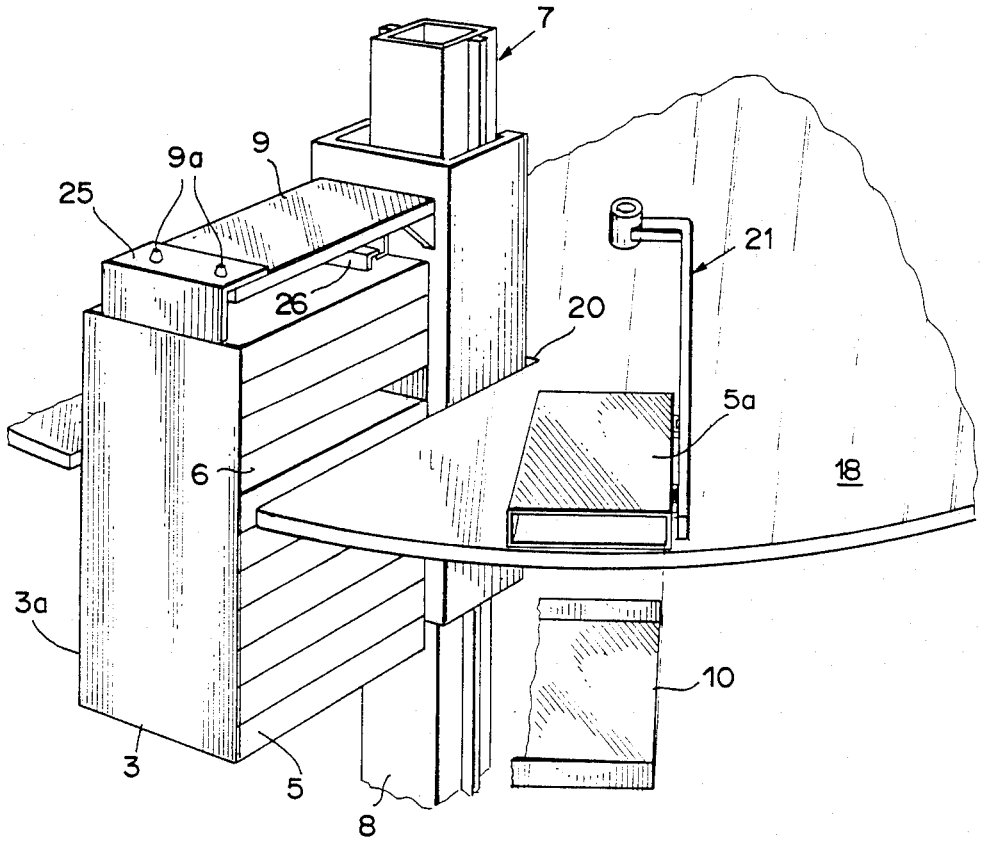
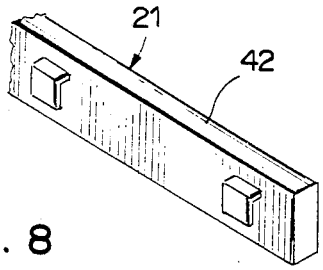
FIG. 8

FIG. 11
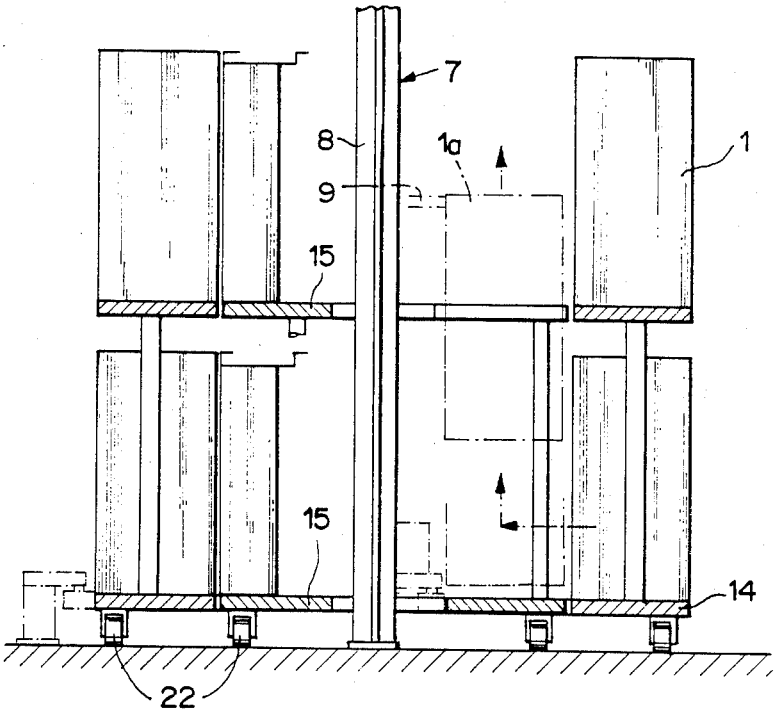
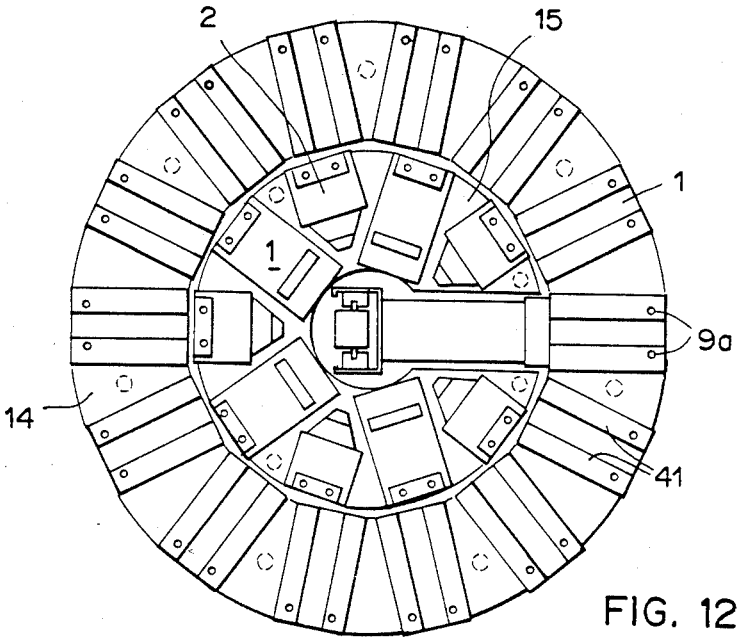
FIG. 12

SAFE-DEPOSIT INSTALLATION

This invention relates to facilities for the safekeeping of valuables, and more particularly to a safe-deposit installation of the type having a plurality of individually accessible safe-deposit boxes disposed one above the other in a number of rectangular racks in such a way that their access openings are all situated on one side of each rack, and a safe surrounding the racks at least partially and having at least one service opening.

Such safe-deposit installations are used particularly in banks but can also be used wherever valuables are to be deposited, e.g., in railroad stations, at airports, in hotels, etc.

An automated banking system is described in European Patent Application Publication No. 51,048. The safe-deposit installation of the system consists of a strongbox assembly rotating about a vertical axis. The strongboxes are so disposed that their entries are situated at the periphery of the arrangement. The strongbox assembly is accommodated in a cell, one wall of which has a large, vertical aperture. This aperture is closed by a number of small doors disposed one above the other. Access to the individual strongbox is made possible by opening one of the small doors.

This prior art strongbox assembly rotates in a horizontal plane about the vertical axis. As a number of vertical columns of strongboxes are provided, access to all of them is possible in the event of a robbery (by breaking through from one strongbox to the next).

An installation disclosed in European Patent Application Publication No. 140,839 comprises at least one receptacle holding a plurality of individually accessible safe-deposit boxes. The receptacle, which is surrounded by a housing having a pass-through, can be displaced vertically along and rotated about a vertical guideway. By such rotation and/or vertical displacement of the receptacle, the openings of the individual safe-deposit boxes, which are disposed along the periphery, are aligned with the pass-through in the housing.

It is an object of this invention to provide an improved safe-deposit installation in which there is no possibility of either lateral or vertical access from one safe-deposit box to another during a robbery.

A further object of the invention is to provide a safe-deposit installation in which the racks can be exchanged at any time and independently of one another.

Still another object is to provide a safe-deposit installation having greatly increased security as compared with prior art installations owing to the considerably longer time needed to break into it.

To this end, in the safe-deposit installation according to the present invention, of the type initially mentioned, each rack is a single-row block which is individually and detachably affixed to a conveyor means movable in a horizontal plane, and there is provided within the vault, separate from the conveyor means, at least one vertical hoist mechanism by means of which the rack selected and conveyed to the starting position by the conveyor means is seizable and raisable vertically to the level of the service opening independently of the other racks.

Figure 2:
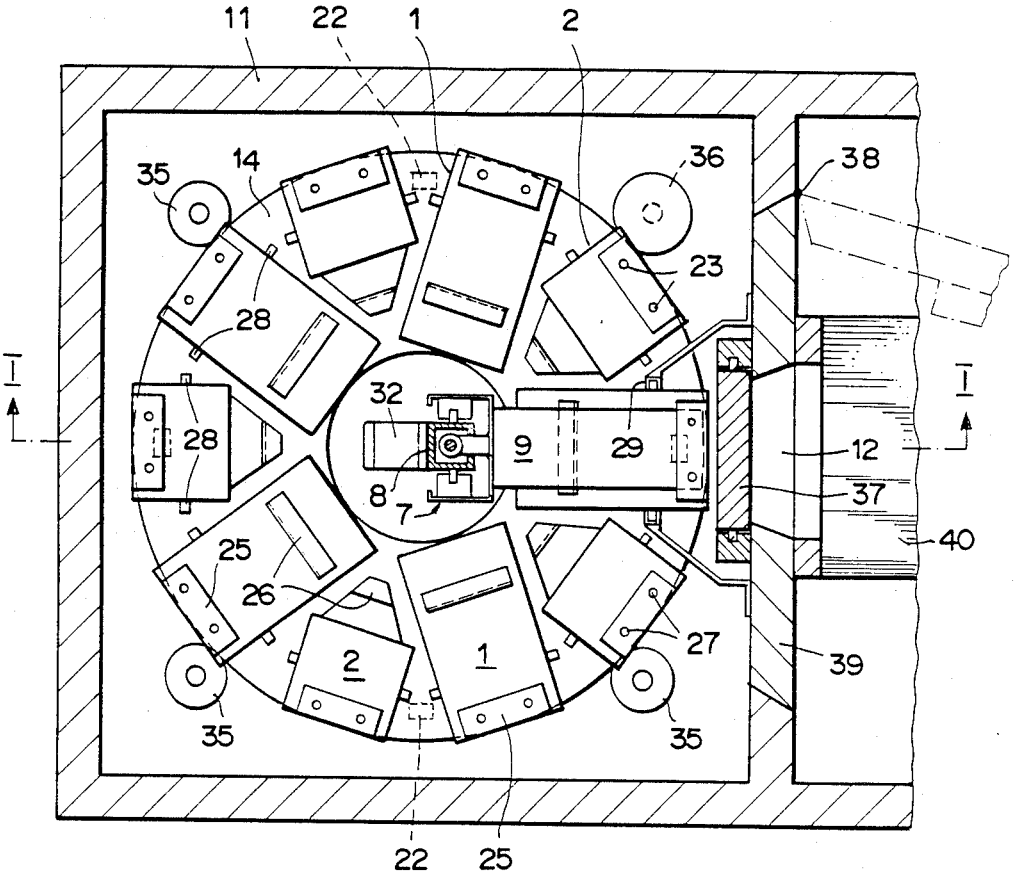
Figure 3:
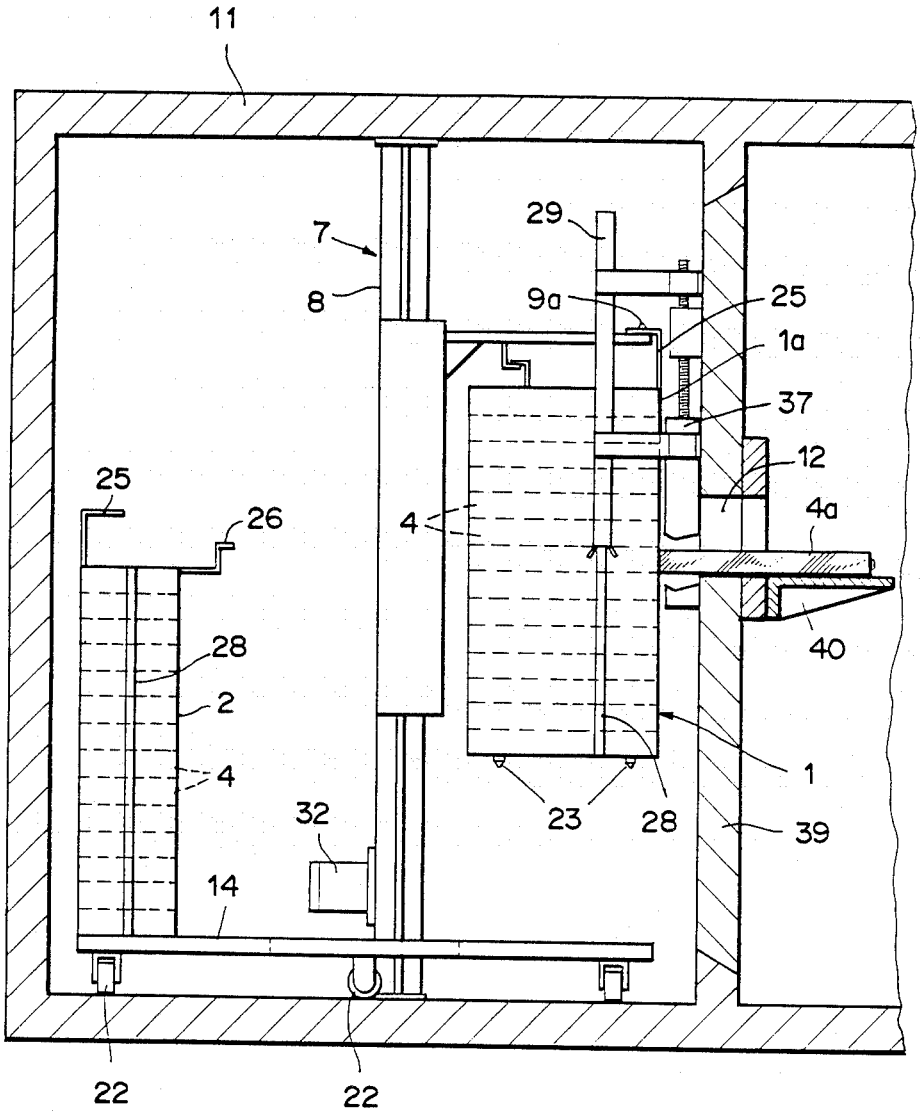
Figure 4:
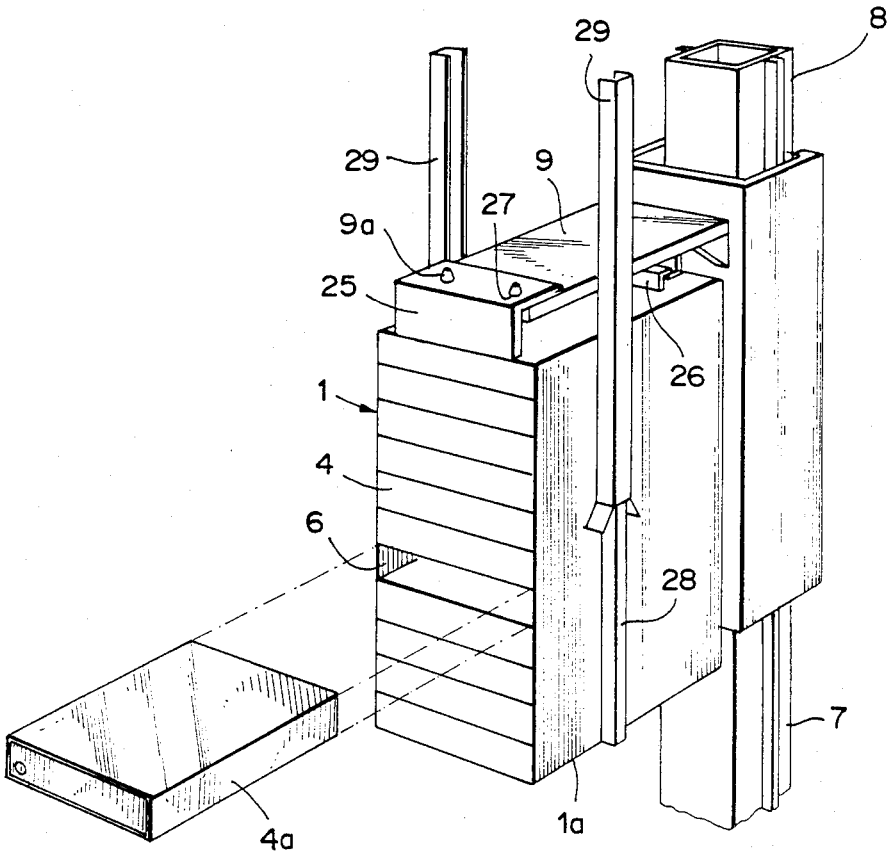
Figure 5:
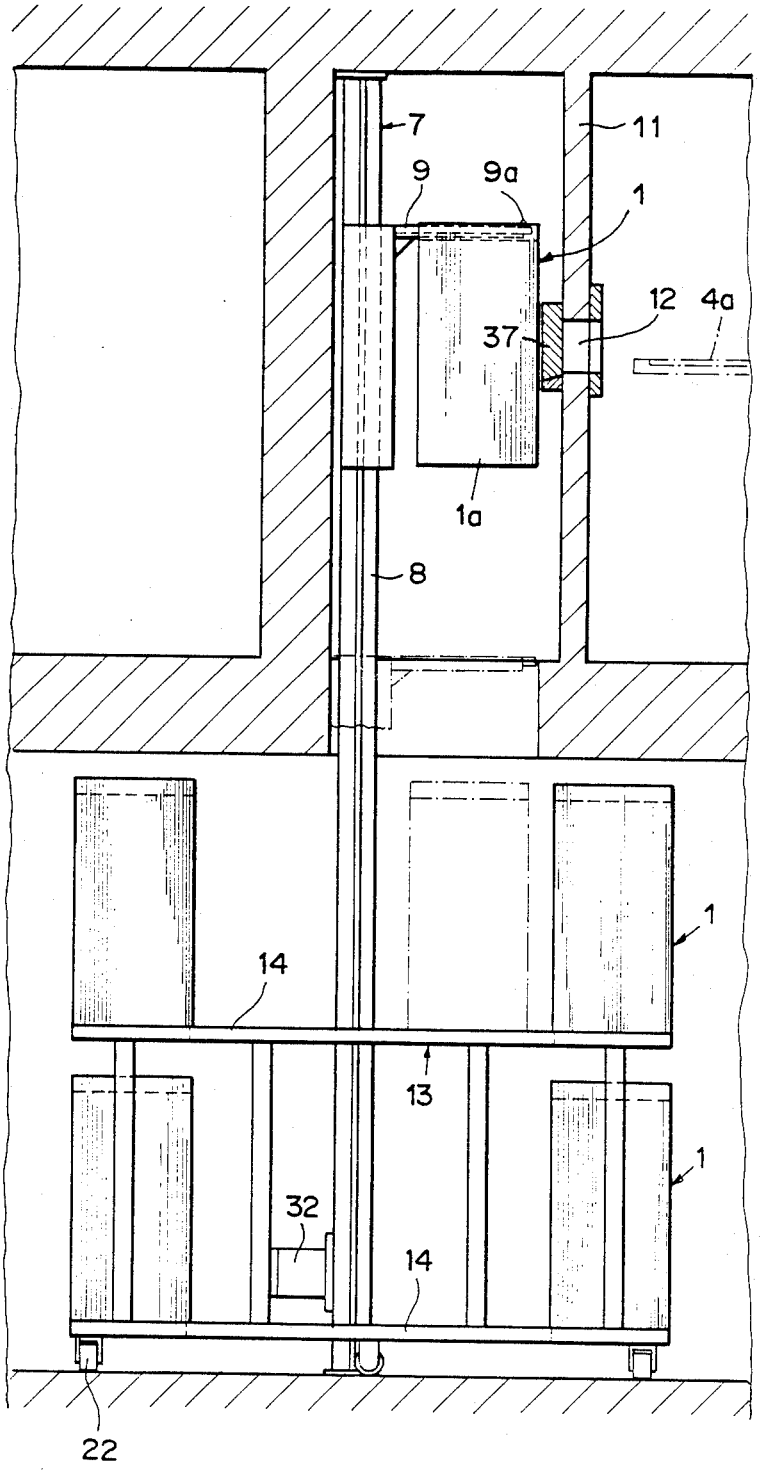
Figure 6:
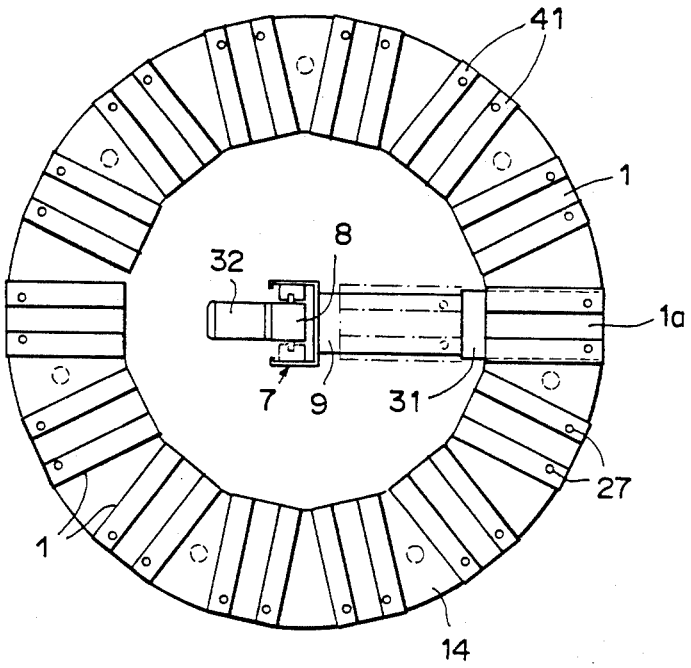
Figure 9:
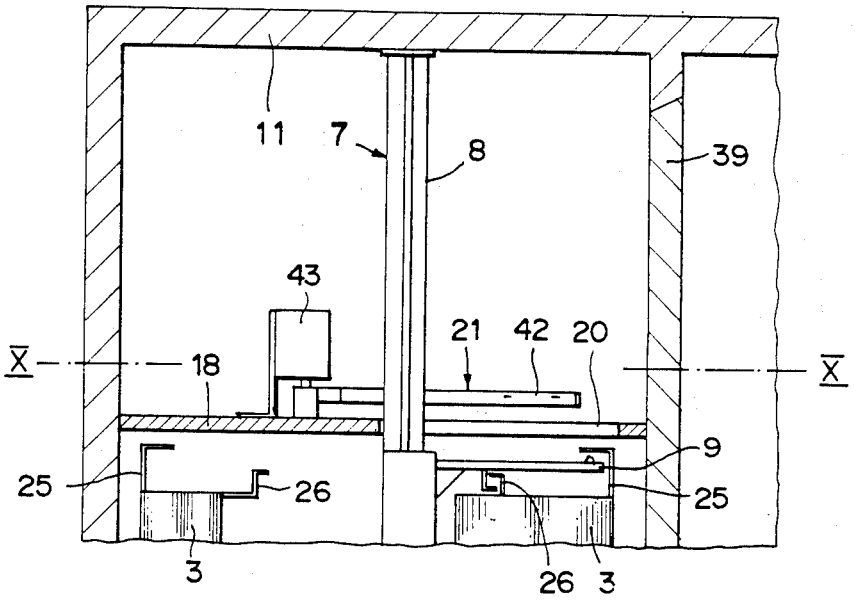
Figure 10:
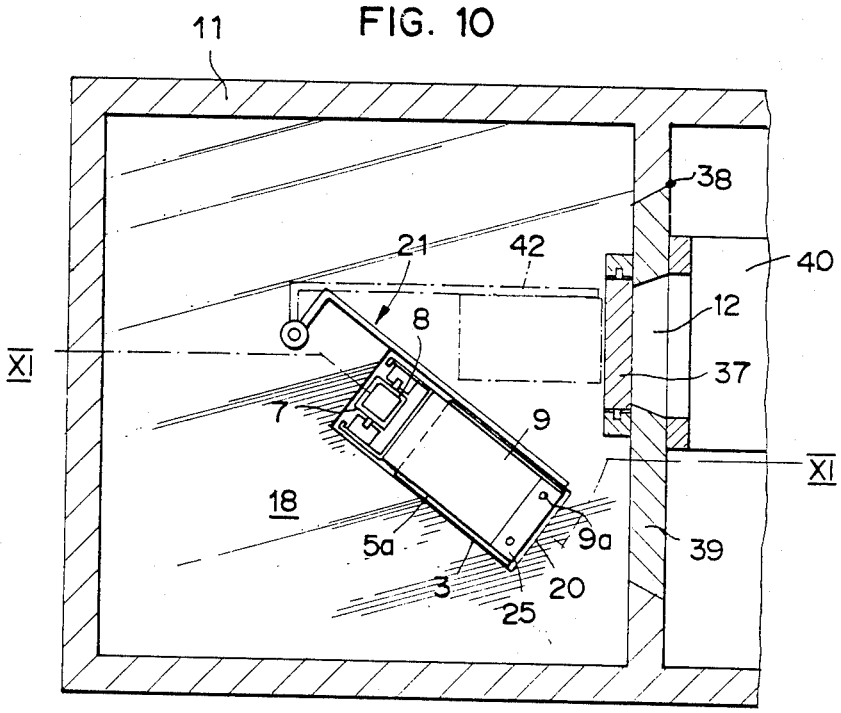
Figure 13:
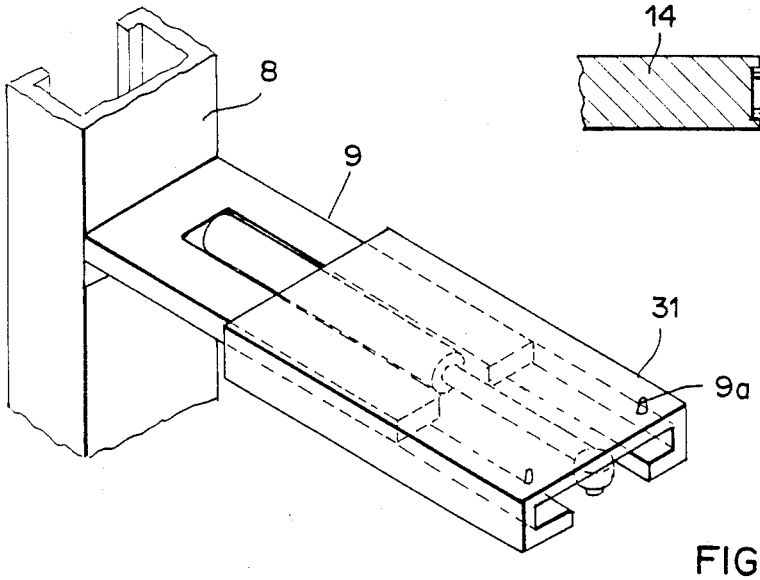
Figure 14:
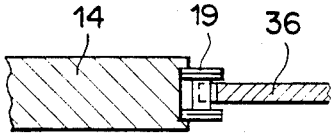

Preferred embodiments of the invention will now be described in detail with reference to the accompanying drawings, in which:

FIG. 1 is a longitudinal section taken on the line I—I of FIG. 2, one of the racks being in its starting position, FIG. 2 is a cross-section taken on the line II—II of FIG. 1, showing an annular turntable and a plurality of racks mounted thereon enclosed within a vault, FIG. 3 is a longitudinal section as in FIG. 1 but with a selected rack in raised position, FIG. 4 is a perspective view of a selected rack in raised position, FIG. 5 is a longitudinal section through an embodiment of the invention having two annular turntables disposed one above the other, only the selected rack in raised position being partially enclosed within the wall of the vault, FIG. 6 is a top plan view of the installation of FIG. 5, some parts being omitted for the sake of clarity, FIG. 7 is a perspective view of a selected rack with safe-deposit boxes in another embodiment, having a partition and a withdrawal element, FIG. 8 is a perspective view of the art of the withdrawal element of FIG. 7, FIG. 9 is a longitudinal section of the withdrawal element of FIG. 7, FIG. 10 is a top plan view, partially in section, of the withdrawal element and partition of FIG. 7, FIG. 11 is a longitudinal section of a safe-deposit installation having two superposed pairs of annular turntables disposed one within the other, FIG. 12 is a top plan view of the installation of FIG. 11, some parts being omitted for the sake of clarity, FIG. 13 is a perspective view of the lifting arm having a telescoping cover plate, FIG. 14 is a sectional view of an annular turntable driven by a sprocket wheel.

Figure 16:
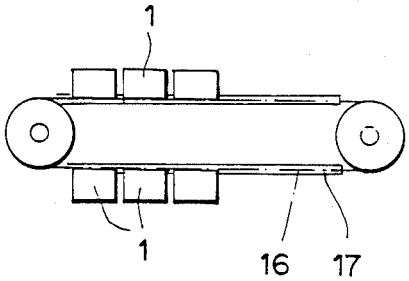
Figure 15:
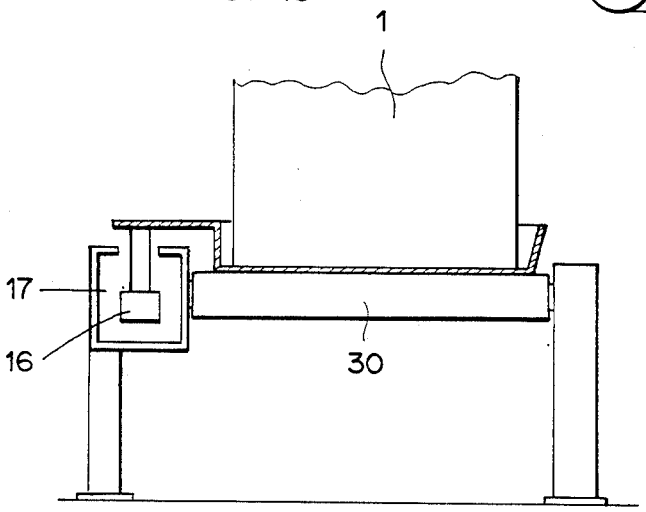

FIG. 15 is an elevation, partially in section, of a chain drive together with the packs and a roller train, and FIG. 16 is a top plan view of the chain drive of FIG. 15.

The embodiment of the safe-deposit installation according to FIGS. 1–4 comprises an annular turntable 14 on which a number of racks 1, 2 are mounted singly and removably. A number of individually accessible safe-deposit boxes 4 are disposed one above the other in the rectangular, single-row racks 1, 2, accommodated in compartments 6 which are all situated on the same side of each rack 1, 2. A vertical rail 28 is affixed to each of the adjacent sides of these racks, which are detachably connected to turntable 14 by means of centering bolts 23, provided on the underside of each rack 1, 2 and snapping into matching recesses on turntable 14.

Turntable 14 and racks 1, 2 mounted thereon are enclosed within a vault 11 having at least one access aperture 12. A vertical hoist mechanism 7 passing through the center of turntable 14 comprises an upright 8 and, extending perpendicular thereto, a lifting arm 9 capable of traveling along upright 8. Arm 9 can be operated electro-mechanically, hydraulically, or pneumatically. In the case of the embodiment illustrated in FIG. 1, it is an electro-mechanical drive comprising an electric motor 32, a threaded spindle 33, and a part 34 screwed on spindle 33.

Turntable 14 rotates about its axis in a horizontal plane. It is supported on casters 22 which run on the floor of vault 11. A ring of ball bearings might be used instead of casters 22. At least three rollers 35 are provided for guiding turntable 14, as shown in FIG. 2. A drive mechanism comprises a sprocket wheel 36 meshing with the chain-like periphery 19 (cf. FIG. 14) of turntable 14. Another possibility would be to provide a fourth roller 35 having a friction surface to act as a drive roller.

As may be seen in FIGS. 1 and 3, upright 8 is secured to vault 11 and may be either fixed or rotary. Although illustrated here as being disposed within turntable 14, upright 8 might also be disposed outside the turntable. The sizes and arrangement of the safe-deposit box compartments in racks 1, 2 need not necessarily be as illustrated here but may be varied as desired. Furthermore, a number of hoist mechanisms may be provided within vault 11.

Through rotation of turntable 14, the selected rack 1*a* is brought into its starting position near the wall of vault 11 having the access aperture 12 and a shelf 40 (FIG. 1). Rack 1*a* is then seized by lifting arm 9 of hoist mechanism 7 in that centering cones or pins 9*a* and an angle iron 9*b* of arm 9 are slid under respective angle irons 25 and 26 of rack 1*a*. Pins 9*a* are thus positioned under holes 27 in angle irons 25 and snap into the latter when arm 9 is raised. Rack 1*a*, which is thus seized independently of the other racks 1, 2, is lifted straight up into the desired position in front of access aperture 12, being guided during this movement by means of rails 28 sliding in tracks 29 affixed to the wall of vault 11. Owing to the engagement of lifting arm 9 with the positioning device comprising angle irons 25, 26, and to the guidance provided by rails 28 and tracks 29, rack 1*a* is raised virtually free of shocks or vibration during its entire upward travel.

Disposed within vault 11 in front of aperture 12 is a vertically sliding armor-plate door 37. When door 37 is pushed upward, the dimensions of aperture 12 are automatically adapted to those of the particular safe-deposit box being presented. Thus door 37 ensures that aperture 12 is open only to the extent necessary for given access to the single safe-deposit box 4. The manner in which door 37 is operated is known per se.

In the wall of vault 11 having aperture 12 is a hatch 39 hung on hinges 38 and affording access to annular turntable 14, racks 1, 2, and hoist mechanism 7 for maintenance purposes.

FIGS. 5 and 6 show an embodiment of the safe-deposit installation having two superposed annular turntables 14 with racks 1. The two turntables 14 are accommodated in an underground room, with only part of hoist mechanism 7 projecting above ground and being enclosed by vault 11.

Arm 9 of hoist mechanism 7 is provided with an extension 31 (FIG. 6) which can be pulled out along arm 9 by means of a spindle (cf. FIG. 13). FIG. 6 shows guideways 41 on the top of each rack 1 into which extension 31 is inserted in order to raise the selected rack 1*a*. When rack 1*a* is returned to its starting position, the opening into the underground room is closed by extension 31, functioning as a cover plate.

A further embodiment of the safe-deposit installation is illustrated in FIGS. 7–10. Safe-deposit boxes 5 are held by racks 3 in compartments 6 opening out on a different side from those of racks 1 and 2. Accordingly, the interior of vault 11 is divided by a horizontal partition 18 situated at the level of access aperture 12. Partition 18 is secured to vault 11 and includes an opening 20 for hoist mechanism 7 and the selected rack 3*a*. A withdrawal element 21 is pivotingly mounted on partition 18. When element 21 is pivoted by an electric motor 43 over to the selected safe-deposit box 5*a*, the latter is seized by claws affixed to the arm 42 (FIG. 8) of element 21 and is pulled out of rack 3*a* laterally onto partition 18, independently of the other safe-deposit boxes 5. Arm 42 might seize safe-deposit box 5*a* electromagnetically instead of by means of claws.

The drawer 10 of safe-deposit box 5*a* is removed by the customer through access aperture 12 (FIG. 10). Rack 3*a* with the other safe-deposit boxes 5 is then returned by hoist mechanism 7 to its starting position or to another position remote from partition 18.

Finally, FIGS. 11 and 12 illustrate still another embodiment of the safe-deposit installation comprising two superposed pairs of turn-tables 14, 15 disposed one within the other for space-saving purposes. As may be seen in FIG. 11, two motors are provided, one for driving the outer turntables and the other for the inner turntables. Upper turntable 15 includes an opening through which selected rack 1 is conveyed when raised from lower turntable 14, as also shown in FIG. 11.

FIGS. 13 and 14 are to be taken in conjunction with FIGS. 6 and 2, respectively, as mentioned earlier.

FIGS. 15 and 16 show a chain drive which may be used instead of the annular turntables. A chain 16 runs along a circular or oval path 17 (FIG. 16). Affixed to chain 16 are racks 1, 2, 3 having differently arranged compartments for the safe-deposit boxes. The racks run over a conveyor 30, preferably a roller train.

The safe-deposit installation described above may be situated in a public building or outside. In front of the installation is an anteroom where the customer is protected while using the facility. It cannot be entered unless the customer first identifies himself, e.g., by keying in a code number with a code card or in some other manner. Not until the customer has thus identified himself satisfactorily, and the anteroom is free, can the door of that room be opened to admit him. Inside the anteroom, the customer again identifies himself to the safe-deposit installation by keying in a code number. If the number is correct and the anteroom door is locked, the desired safe-deposit box from the selected rack will be moved into the position behind the armor-plate door at the access aperture. The armor-plate door then slides open, and the safe-deposit box becomes accessible to the customer, so that he can open it with his key and lock it again when he is finished with it. The armor-plate door closes automatically, and the customer leaves the anteroom.

This safe-deposit installation offers security advantages inasmuch as the selected rack is raised up away from the remaining racks, so that there is no possibility of access from a safe-deposit box in one rack to that of another rack. Even if an authorized-access box is opened and then broken through at the side, there is nothing but empty space next to it. Since no two-dimensional movement takes place in the safe-deposit installation, but only horizontal movements of the conveying means and vertical movements of the hoist mechanism, successively and separately, this means added security. The individual racks can be exchanged, or the sizes changed, after opening of the maintenance hatch of the vault. The conveying means can likewise be adapted to the respective vault size or to the rooms. The safe-deposit installation also makes it possible to provide several access apertures at various floor levels with access to the individual racks. Finally, provision may be made for purely manual mechanical operation, e.g., in case the electricity goes off, but only in the presence of a supervisory person.

What is claimed is:

1. A safe-deposit installation of the type having a plurality of rectangular racks, a plurality of individually accessible safe-deposit boxes disposed one above said other in each of said racks and including compartments for receiving said safe-deposit boxes, said compartments all opening out on one side of each of said racks, and a vault surrounding said racks at least partially and including at least one access aperture, wherein the improvement comprises:

at least one vertical hoist mechanism situated within said vault and including means for seizing and raising a selected one of said racks to the level of said access aperture independently of the other said racks, conveyor means separate from said hoist mechanism and movable in a horizontal plane for presenting said selected one of said racks to said hoist mechanism, means for affixing said racks individually and detachably to said conveyor means, each of said racks containing only a single row of said safe-deposit boxes, wherein said compartments are of various sizes, and said conveying means takes the form of at least one annular turntable, further comprising rolling means disposed beneath said turntable, said means for affixing said racks to said conveyor means taking the form of centering pins, each of said racks comprising positioning means, and said hoist mechanism comprising an upright and a lifting arm perpendicular to and movable along said upright and including further centering pins intended to engage said positioning means.

2. The safe-deposit installation of claim 1, wherein said rolling means take the form of casters.

3. The safe-deposit installation of claim 1, wherein said rolling means take the form of a ring of ball bearings.

4. The safe-deposit installation of claim 1, wherein said positioning means comprise two angle irons secured to each of said racks, one of said angle irons including holes for receiving said further centering pins.

5. The safe-deposit installation of claim 1 comprising a plurality of superposed said annular turntables.

6. The safe-deposit installation of claim 1, comprising a plurality of pairs of said annular turntables disposed one within the other.

7. The safe-deposit installation of claim 1, further comprising a cover plate telescopingly mounted on said lifting arm.

8. The safe-deposit installation of claim 1, wherein said hoist mechanism is situated outside said conveying means.

9. A safe-deposit installation of the type having a plurality of rectangular racks, a plurality of individually accessible safe-deposit boxes disposed one above said other in each of said racks and including compartments for receiving said safe-deposit boxes, said compartments all opening out on one side of each of said racks, and a vault surrounding said racks at least partially and including at least one access aperture, wherein the improvement comprises:

at least one vertical hoist mechanism situated within said vault and including means for seizing and raising a selected one of said racks to the level of said access aperture independently of the other said racks, conveyor means separate from said hoist mechanism and movable in a horizontal plane for presenting said selected one of said racks to said hoist mechanism, means for affixing said racks individually and detachably to said conveyor means, each of said racks containing only a single row of said safe-deposit boxes, further comprising a horizontal partition secured to said vault and dividing the interior of said vault at the level of said access aperture, said partition including an opening for the passage of said hoist mechanism and said selected one of said racks, a withdrawal element pivoted on said partition for withdrawing a selected one of said safe-deposit boxes from said selected one of said racks onto said partition, and means for returning said selected one of said racks to a position remote from said access aperture.

10. A safe-deposit installation of the type having a plurality of rectangular racks, a plurality of individually accessible safe-deposit boxes disposed one above said other in each of said racks and including compartments for receiving said safe-deposit boxes, said compartments all opening out on one side of each of said racks, and a vault surrounding said racks at least partially and including at least one access aperture, wherein the improvement comprises:

at least one vertical hoist mechanism situated within said vault and including means for seizing and raising a selected one of said racks to the level of said access aperture independently of the other said racks, conveyor means separate from said hoist mechanism and movable in a horizontal plane for presenting said selected one of said racks to said hoist mechanism, means for affixing said racks individually and detachably to said conveyor means, each of said racks containing only a single row of said safe-deposit boxes, further comprising two vertical rails respectively affixed to opposing sides of each of said racks, and two vertical tracks affixed to said vault, matching said rails, and co-operating therewith for guiding said selected one of said racks.

* * * * *